US008787602B2

(12) United States Patent
Macours

(10) Patent No.: US 8,787,602 B2
(45) Date of Patent: Jul. 22, 2014

(54) DEVICE FOR AND A METHOD OF PROCESSING AUDIO DATA

(75) Inventor: Christophe Marc Macours, Hodeige (BE)

(73) Assignee: NXP, B.V., Eindhoven (NL)

( * ) Notice: Subject to any disclaimer, the term of this patent is extended or adjusted under 35 U.S.C. 154(b) by 904 days.

(21) Appl. No.: 12/855,557

(22) Filed: Aug. 12, 2010

(65) Prior Publication Data

US 2011/0038484 A1 Feb. 17, 2011

(30) Foreign Application Priority Data

Aug. 17, 2009 (EP) ..... 09168012

(51) Int. Cl.

| | |
|---|---|
| ***H04R 5/02*** | (2006.01) |
| ***H04R 5/033*** | (2006.01) |
| ***H04R 29/00*** | (2006.01) |
| ***H04R 3/12*** | (2006.01) |

(52) U.S. Cl.

USPC ..... 381/309; 381/56; 381/74; 381/300

(58) Field of Classification Search

USPC ..... 381/300, 303–305, 309, 311, 56–59, 381/71.4, 71.6, 71.7, 97, 89, 122, 74

See application file for complete search history.

(56) References Cited

U.S. PATENT DOCUMENTS

| | | | | |
|---|---|---|---|---|
| 5,434,921 | A * | 7/1995 | Dombrowski et al. | 381/1 |
| 5,959,597 | A * | 9/1999 | Yamada et al. | 345/8 |
| 7,555,134 | B2 * | 6/2009 | Dunn et al. | 381/309 |
| 7,936,887 | B2 * | 5/2011 | Smyth | 381/74 |
| 7,995,770 | B1 * | 8/2011 | Simon | 381/82 |
| 8,050,444 | B2 * | 11/2011 | Smith | 381/379 |
| 8,208,654 | B2 * | 6/2012 | Coutinho et al. | 381/81 |
| 8,362,972 | B2 * | 1/2013 | Miyakawa et al. | 345/8 |
| 2003/0235311 | A1 * | 12/2003 | Grancea et al. | 381/58 |

(Continued)

FOREIGN PATENT DOCUMENTS

| | | |
|---|---|---|
| CA | 2 387 036 A1 | 12/1999 |
| EP | 0 464 217 A1 | 1/1992 |

(Continued)

OTHER PUBLICATIONS

Tikander, M. et al. "Binaural Positioning System for Wearable Augmented Reality Audio," IEEE Applications of Signal Processing to Audio and Acoustics, pp. 153-56 (Oct. 2003).

Extended European Search Report for European Patent Appln. No. 09168012.4 (Mar. 8, 2010).

*Primary Examiner* — Davetta W Goins
*Assistant Examiner* — Daniel Sellers

(57) ABSTRACT

A device (100) for processing audio data, wherein the device (100) comprises a first audio reproduction unit (102) adapted for reproducing a first part of the audio data and adapted to be attached to a left ear (106) of a user (110), a second audio reproduction unit (104) adapted for reproducing a second part of the audio data and adapted to be attached to a right ear (108) of the user (110), a detection unit (112) adapted for detecting a left/right inversion of the first audio reproduction unit (102) and the second audio reproduction unit (104), and a control unit (114) adapted for controlling the first audio reproduction unit (102) for reproducing the second part of the audio data and for controlling the second audio reproduction unit (104) for reproducing the first part of the audio data upon detecting the left/right inversion.

12 Claims, 2 Drawing Sheets

(56) References Cited

U.S. PATENT DOCUMENTS

| | | | | |
|---|---|---|---|---|
| 2005/0123143 | A1* | 6/2005 | Platzer et al. | 381/2 |
| 2005/0259832 | A1* | 11/2005 | Nakano | 381/92 |
| 2007/0036363 | A1* | 2/2007 | Hollemans et al. | 381/59 |
| 2008/0089539 | A1* | 4/2008 | Ishii | 381/311 |

FOREIGN PATENT DOCUMENTS

| | | | |
|---|---|---|---|
| JP | 2002-135887 | A | 5/2002 |
| WO | 99/66778 | A2 | 12/1999 |
| WO | 2005/029911 | A1 | 3/2005 |

* cited by examiner

DEVICE FOR AND A METHOD OF PROCESSING AUDIO DATA

This application claims the priority under 35 U.S.C. §119 of European patent application no. 09168012.4, filed on Aug. 17, 2010, the contents of which are incorporated by reference herein.

FIELD OF THE INVENTION

The invention relates to a device for processing audio data.

Beyond this, the invention relates to a method of processing audio data.

Moreover, the invention relates to a program element.

Furthermore, the invention relates to a computer-readable medium.

BACKGROUND OF THE INVENTION

Headphone listening is getting more and more popular due to the penetration of portable audio players. Even mobile phones nowadays also allow music playback on headphones. Headphones are also increasingly used in rear-seat entertainment (RSE) systems: this allows people sitting at the back of the car to listen to music or watch DVDs without being disturbed by the music being played on the main car audio installation, and without disturbing the front passengers.

Another key trend is the growing use of Active Noise Reduction (ANR) headphones, which isolates the user from the ambient sound (for instance car/aircraft engine noise, fan noise, train/metro) by means of anti-sound played through the headphone loudspeakers. The anti-sound is calculated from microphones placed on the headphone.

A usual shortcoming encountered while using headphones is the need to respect the left/right order, i.e. ensuring that the left (right) headphone is on the left (right) ear. A left/right inversion may be not dramatic in case of music listening, but for instance in case of movie playback and augmented reality systems (such as auditory displays), a left/right inversion has a negative impact on the overall experience. In both cases, the sound sources played on the headphone indeed relate to a physical location (the screen in case of movie playback, a physical location in case of auditory displays).

Although headphones may be marked with a "L" on the left earpiece and a "R" on the right earpiece, it is not convenient for the user to look for those indications each time the user has to put the headphones on. Some conventions exist though, like cable plug on the left side for full-size headphones or shorter cable on the left side for in-ear headphones, but they are not generalized and do not prevent the user from swapping the channels inadvertently.

OBJECT AND SUMMARY OF THE INVENTION

It is an object of the invention to provide an audio system which is convenient in use for a listener.

In order to achieve the object defined above, a device for processing audio data, a method of processing audio data, a program element and a computer-readable medium according to the independent claims are provided.

According to an exemplary embodiment of the invention, a device for processing audio data (which may comprise or which may consist of a first part of audio data and a second part of audio data) is provided, wherein the device comprises a first audio reproduction unit (which may also be denoted as a left ear audio reproduction unit) adapted for reproducing, in a default mode, a first part of the audio data (which may also be denoted as left ear audio data) and adapted (particularly intended) to be attached to a left ear of a user, a second audio reproduction unit (which may also be denoted as a right ear audio reproduction unit) adapted for reproducing, in the default mode, a second part of the audio data (which may also be denoted as right ear audio data which may be different from the first part of the audio data, and in a stereo configuration may be complementary to the first part of the audio data) and adapted (particularly intended) to be attached to a right ear of the user, a detection unit adapted for detecting a possible left/right inversion of the first audio reproduction unit and the second audio reproduction unit, and a control unit adapted for controlling the first audio reproduction unit for reproducing the second part of the audio data and for controlling the second audio reproduction unit for reproducing the first part of the audio data upon detecting the left/right inversion (in an embodiment, the control unit may further be adapted for controlling the first audio reproduction unit for continuing the reproduction of the first part of the audio data and for controlling the second audio reproduction unit for continuing the reproduction of the second part of the audio data upon detecting the absence of a left/right inversion; in other words, in a left/right inversion mode differing from the default mode, the first audio reproduction unit and the second audio reproduction unit may be controlled to interchange the reproduction of the first and the second part of the audio data selectively upon detection that the first audio reproduction unit has been erroneously attached to the right ear and that the second audio reproduction unit has been erroneously attached to the left ear of the user).

According to another exemplary embodiment of the invention, a method of processing audio data is provided, wherein the method comprises reproducing a first part of the audio data by a first audio reproduction unit to be attached to a left ear of a user, reproducing a second part of the audio data by a second audio reproduction unit to be attached to a right ear of the user, detecting a left/right inversion of the first audio reproduction unit and the second audio reproduction unit, and, upon detecting the left/right inversion, controlling the first audio reproduction unit for reproducing the second part of the audio data and controlling the second audio reproduction unit for reproducing the first part of the audio data.

According to still another exemplary embodiment of the invention, a program element (for instance a software routine, in source code or in executable code) is provided, which, when being executed by a processor, is adapted to control or carry out an audio data processing method having the above mentioned features.

According to yet another exemplary embodiment of the invention, a computer-readable medium (for instance a CD, a DVD, a USB stick, a floppy disk or a harddisk) is provided, in which a computer program is stored which, when being executed by a processor, is adapted to control or carry out an audio data processing method having the above mentioned features.

Data processing for audio reproduction correction purposes which may be performed according to embodiments of the invention can be realized by a computer program, that is by software, or by using one or more special electronic optimization circuits, that is in hardware, or in hybrid form, that is by means of software components and hardware components.

The term "audio data" may particularly denote any audio piece which is to be reproduced by an audio reproduction device, particularly the loudspeaker of the device. Such audio content may include audio information stored on a storage device such as a CD, a DVD or a harddisk or may be broadcasted by a television or radio station or via a communication network such as the public Internet or a telecommunication network. It may be a movie sound, a music song, speech, an audio book, sound of a computer game or the like.

The term "audio reproduction unit" may particularly denote an entity capable of converting electronic audio data into corresponding acoustic waves perceivable by an ear of a human listener having attached the audio reproduction unit. Hence, an audio reproduction unit may be a loudspeaker which may, for instance, be integrated in an earpiece for selective and spatially limited playback of audio data.

The term "left/right inversion" of the two audio reproduction units may particularly denote that the user has erroneously interchanged or inverted the two audio reproduction units, i.e. has attached the right ear audio reproduction unit to the left ear and the left ear audio reproduction unit to the right ear. Consequently, in the presence of such an inadvertent swapping of two audio playback units, audio data intended for supply to the left ear may be supplied to the right ear, and vice versa. The assignment of an audio reproduction unit to a "left" ear or a "right" ear may be purely logical, i.e. may be defined by the audio reproduction system, and/or may be indicated to a user of the audio reproduction system, for instance by marking two audio reproduction units by an indicator such as "left" or "L" and as "right" or "R", respectively.

According to an exemplary embodiment of the invention, a system may be provided which automatically detects that a user wears headphones or other audio reproduction units in an erroneous manner, i.e. that the user has attached a first audio reproduction unit (to be correctly attached to a left ear) to a right ear and has attached a second audio reproduction unit (to be attached correctly to the right ear) to the left ear. In the case of the reproduction of orientation-dependent or spatially-dependent audio data, such a left/right inversion may have a negative impact on the perception of the audio data. Hence, a self-acting detection system may be provided by an exemplary embodiment which may recognize the erroneous wearing of the headphones and may exchange the audio data to be reproduced by the two audio reproduction units upon detection of such an erroneous wearing mode. In other words, the first audio reproduction unit is then operated to reproduce right ear audio data and the second audio reproduction unit is then operated to reproduce left ear audio data. Thus, without requiring a user to perform a correction action and hence in a user-convenient manner, it may be ensured that even an unskilled user can safely enjoy orientation or position-dependent audio data in a simple and reliable manner.

In the following, further exemplary embodiments of the device will be explained. However, these embodiments also apply to the method, to the computer-readable medium and to the program element.

The detection unit may comprise a first signal detection unit located at a position of the first audio reproduction unit (for instance directly adjacent to the first audio reproduction unit, for instance both being integrated in the same earpiece) and adapted for detecting a first detection signal and comprises a second signal detection unit located at a position of the second audio reproduction unit (for instance directly adjacent to the second audio reproduction unit, for instance both being integrated in the same earpiece) and adapted for detecting a second detection signal. The detection unit may be adapted for detecting the left/right inversion based on an evaluation of the first detection signal and the second detection signal, particularly based on a time correlation between these two signals. Therefore, each of the audio reproduction units (which may be loudspeakers) may be logically and spatially assigned to a respective signal detection unit capable of detecting audio data or other data (such as inaudible ultrasound). Also other detection signals such as electromagnetic radiation-based detection signals can be implemented. Thus, the time characteristic of a signal may be evaluated for each of the audio reproduction units. Consequently, position information regarding the audio reproduction units may be estimated, and a possible left/right inversion may be detected.

Still referring to the previously described embodiment, the detection unit may further be adapted for detecting the left/right inversion by determining a time difference between the signal detected by the first signal detection unit and the signal detected by the second detection unit. It is also possible that a relative time shift between the signals assigned to the audio reproduction units is analyzed. Particularly, a run time difference of the signal between the emission by a signal source (such as an acoustic source, an ultrasound source or an electromagnetic radiation source) and the arrival at the position of respective signal detection units may be determined.

Still referring to the previous embodiment, the first signal detection unit may comprise a first microphone and the second signal detection unit may comprise a second microphone. These microphones may then be used for detecting the respective detection signal.

Such an embodiment can be realized in a particularly simple and efficient manner using an Active Noise Reduction (ANR) system which may already have assigned to each loudspeaker a corresponding microphone. Although this microphone is predominantly used for another purpose in an Active Noise Reduction system (namely for detecting environmental noise to allow to correspondingly manipulate a played back audio signal to compensate for audible disturbation in an environment), these microphones can be used synergetically for detecting the signal which allows to determine the positions of the two audio reproduction unit and therefore to determine a possible left/right inversion.

In an ANR system implemented according to an exemplary embodiment, a noise-cancellation speaker may emit a sound wave with the same amplitude but with inverted phase to the original sound. The waves combine to form a new wave, in a process called interference, and effectively cancel each other out by phase cancellation. The resulting sound wave may be so faint as to be inaudible to human ears. The transducer emitting the cancellation signal may be located at the location where sound attenuation is wanted (for instance the user's ears). In an embodiment, the first audio reproduction unit and the second audio reproduction unit may be adapted for Active Noise Reduction. Active Noise Reduction (ANR) headsets may reduce the exposure to ambient noise by playing so-called "anti-noise" through headset loudspeakers. A basic principle is that the ambient noise is picked up by a microphone, filtered and phase-reversed with an ANR filter, and sent back to the loudspeaker. In case of a feed forward ANR, the microphone may be arranged outside the ear cup. In case of a feedback ANR, the microphone may be arranged inside the ear cup. The additional microphones used for Active Noise Reduction may be simultaneously and synergetically used as well for the detection of a possible left/right inversion.

However, other embodiments of the invention may be implemented in others than Active Noise Reduction system. Hence, the addition of separate microphones spatially located at the positions of the audio reproduction units is possible even without providing an ANR function.

The device may further comprise a signal emission unit adapted for emitting a reference signal for detection by the first signal detection unit as the first detection signal and by the second signal detection unit as the second detection signal. Such a signal emission unit or signal source may be positioned at a pre-known reference position so that a detected pair of detection signals at the differing positions of the signal detection units may allow deriving the relative spatial relationship between the two audio reproduction units.

For example, the signal emission unit may emit an audible reference signal. Such an audible reference signal may be an audio sound which is to be reproduced anyway for perception by a human user such as audio content. Alternatively, the audible reference signal may be a dedicated audio test signal specifically used for the calibration and left/right inversion.

In still another embodiment, the reference signal may be an inaudible reference signal such as ultrasound or may also be an electromagnetic radiation beam. Such a signal is not perceivable by a user and therefore does not disturb the audible perception of the user.

In an embodiment, the signal emission unit may comprise at least one further audio reproduction unit adapted for reproducing further audio data independently from the first audio reproduction unit and the second audio reproduction unit, wherein the reproduced further audio data may constitute the reference signal. Therefore, one or more further loudspeakers as further audio reproduction units may be arranged in an environment of the first and the second audio reproduction units (which may be represented by a headphone or the like) so that such further audio reproduction unit or units may serve for generating the reference signal, i.e. may function as the signal emission unit for emitting a reference signal. Therefore, the left/right inversion can be performed in a very simple manner without additional hardware requirements when one or more further loudspeakers are positioned anyway in an environment of the headphones forming the first and the second audio reproduction units.

This is the case, for example, in a rear seat entertainment system of a car. Such an embodiment may be particularly appropriate since signal emission units are already present anyway in the acoustic environment of the audio reproduction units, for instance in an in-car rear seat entertainment system in which loudspeakers (which can be simultaneously used as signal emission unit or units) are present for emitting acoustic sound, and a person sitting in the rear of the car can use a headphone for enjoying audio content.

Advantageously, the signal emission unit is fixedly installed at a preknown reference position. In this case, the position information (for instance a specific position within a passenger's cabin of a car) may be used as a reference information based on which the position of the first and the second audio reproduction units may be determined when analyzing a time difference between arrival times of a reference signal at the respective position of the first and the second audio reproduction units.

Exemplary applications of exemplary embodiments of the invention are rear seat entertainment systems for a car, congress systems including headphones for translation or interpretation, in-flight entertainment systems, etc. The audio reproduction units may form part of a headset, a headphone or an earphone. Other applications are possible as well. Embodiments may be particularly applied to all environments where a listener wearing headphones is surrounded by a fixed loudspeaker set-up, for example rear-seat entertainment (RSE), congress systems (headphones for translation), in-flight entertainment (IFE) headphones, etc.

For instance, the device according to the invention may be realized as one of the group consisting of a mobile phone, a hearing aid, a television device, a video recorder, a monitor, a gaming device, a laptop, an audio player, a DVD player, a CD player, a harddisk-based media player, a radio device, an internet radio device, a public entertainment device, an MP3 player, a car entertainment device, a medical communication system, a body-worn device, a speech communication device, a home cinema system, a home theatre system, a flat television apparatus, an ambiance creation device, a studio recording system, or a music hall system. However, these applications are only exemplary, and other applications in many fields of the art are possible.

The aspects defined above and further aspects of the invention are apparent from the examples of embodiment to be described hereinafter and are explained with reference to these examples of embodiment.

BRIEF DESCRIPTION OF THE DRAWINGS

The invention will be described in more detail hereinafter with reference to examples of embodiment but to which the invention is not limited.

DESCRIPTION OF EMBODIMENTS

Figure 1:
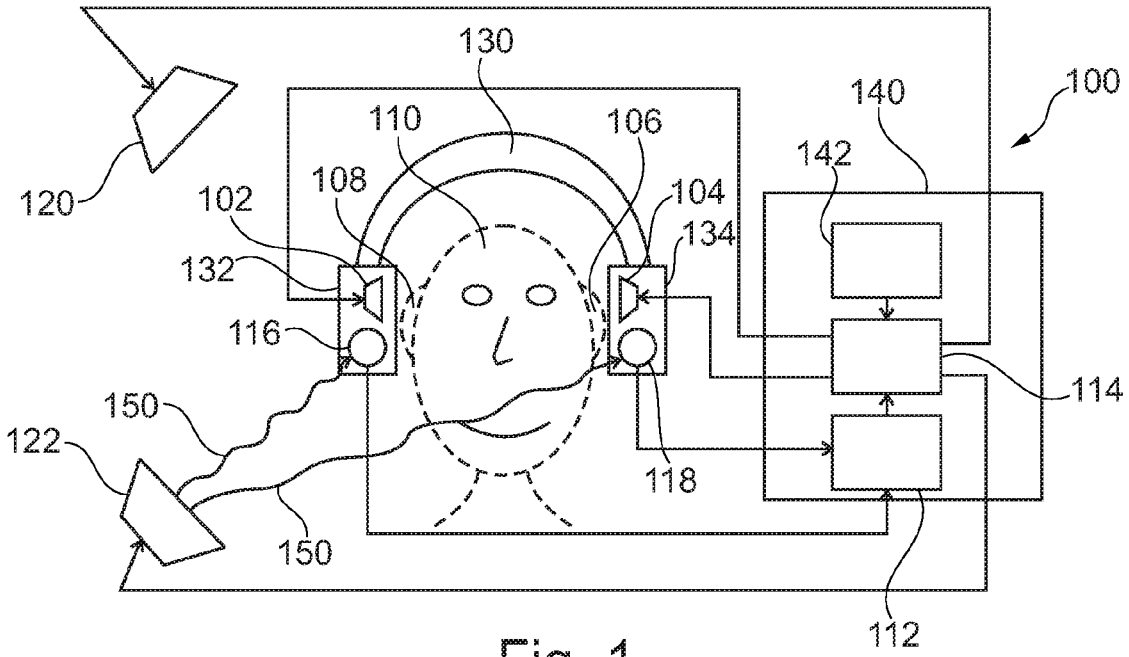
FIG. 1 illustrates a system of processing audio data according to an exemplary embodiment of the invention.

The illustration in the drawing is schematically. In different drawings, similar or identical elements are provided with the same reference signs.

According to an exemplary embodiment of the invention, an automatic left/right headphone inversion detection, for instance for rear-seat entertainment headphones, may be provided. An embodiment provides a system for automatically detecting left/right inversion for instance for Active Noise Reduction headphones used for in-car rear-seat entertainment. Such a system may exploit the fact that microphones on a headset (one on each side of the listener's head) are surrounded by loudspeakers from the car audio installation that are playing known signals. It may make it possible to monitor the acoustical paths between one (or more) of those loudspeakers and the two headset microphones. For each loudspeaker, the least delayed microphone should be the one on the same side as the loudspeaker. If not, it indicates that the headphone is swapped and an automatic channel swapping can be done.

In the following, referring to FIG. 1, an audio reproduction system 100 according to an exemplary embodiment of the invention will be explained.

FIG. 1 shows a user 110 having a left ear 106 and a right ear 108 and wearing a headphone 130. The headphone 130 comprises a first ear cup 132 and a second ear cup 134. The first ear cup 132 comprises a first loudspeaker 102 for emitting sound waves and a first microphone 116 for capturing sound waves. The second ear cup 134 comprises a second loudspeaker 104 for emitting sound waves and a second microphone 118 for capturing sound waves. The user 110 wearing the headphones 130 sits in a rear seat of a car which is equipped with a car entertainment system which also comprises a third loudspeaker 120 and a fourth loudspeaker 122 which are arranged spatially fixed at pre-known positions within a passenger cabin of the car. All loudspeakers 120, 122, 102, 104 are connected to an audio reproduction system 140 such as a HiFi system of the car. An audio data storage unit 142 is provided (for instance a harddisk, a CD, etc.) and stores audio content such as a song, a movie, etc. to be played back. Therefore, the reproduced data comprises audio data and can optionally also include video data. In the shown embodiment, the user 110 reproduces the multimedia content stored on the audio data storage device 142.

Furthermore, a processor (for instance a microprocessor or a central processing unit, CPU) is provided and is shown and denoted with reference numerals 112, 114. This processor is capable of detecting and eliminating possible left/right inversion of the headphones 130, as will be explained below.

In a scenario (not shown in FIG. 1) in which the user 110 correctly wears the first ear cup 132 and the second ear cup 134, the first ear cup 132 would be attached to the left ear 106 and the second ear cup 134 would be attached to the right ear 108 of the user 110. If this would be the case, the loudspeaker 102 plays back audio content intended to be supplied to the left ear 106, and the loudspeaker 104 plays back different audio content intended to be supplied to the right ear 108. In case that the audio content to be reproduced includes a spatial information (for instance is correlated to video content of a movie which can be reproduced simultaneously, for instance speech including a spatial information at which position on a display an actor is presently located), the correct location of the first ear cup 132 on the left ear 106 and the second ear cup 134 on the right ear 108 may be important. The playback mode in the described desired wearing configuration may be denoted as a "default mode".

However, FIG. 1 shows another scenario in which the first ear cup 132 and thus the loudspeaker 102 is erroneously attached to the right ear 108 and the second ear cup 134 and thus the loudspeaker 104 is erroneously attached to the left ear 106, so that the audio content played back by the loudspeakers 102, 104 would be swapped compared to a desired wearing scenario. A correct operation of the headphone 130 would require attaching the first loudspeaker 102 to the left ear 106 and the second loudspeaker 104 to the right ear 108. As a result of the incorrect wearing of the first loudspeaker 102 and the second loudspeaker 104, right ear audio data would be incorrectly reproduced by the second loudspeaker 104 and left ear audio data would be incorrectly reproduced by the first loudspeaker 102. However, it is cumbersome for a user 110 to recognize such a left/right inversion and to eliminate it manually by correctly attaching the first loudspeaker 102 to the left ear 106 and the second loudspeaker 104 to the right ear 108.

To overcome this shortcoming, the system 100 according to an exemplary embodiment of the invention provides for an automatic correction of the incorrect wearing of the first ear cup 132 and the second ear cup 134, as will be described in the following. The correspondingly adjusted playback mode in the wearing configuration shown in FIG. 1 may be denoted as a "left/right inversion mode".

To correct the playback mode, a detection processing unit 112 forming part of the above described processor is adapted for detecting the left/right inversion of the first and the second loudspeakers 102, 104. In view of the detected left/right conversion, a control unit 114 forming part of the processor as well is adapted for controlling the first loudspeaker 102 (erroneously attached to the right ear 108 and normally reproducing the left ear audio data) for now reproducing the right ear audio data. Correspondingly, the control unit 114 is adapted for controlling the second loudspeaker 104 (erroneously attached to the left ear 106 and normally reproducing the right ear audio data) for now reproducing the left ear audio data. In other words, the dedicated audio data to be played back by the loudspeakers 102, 104 is simply converted. To compensate the inverted wearing state of the loudspeakers 102, 104, the reproduced audio data is inverted as well to compensate for the inverted wearing state, thereby correcting the audio data supplied to the left ear 106 and the right ear 108. Hence, in the left/right inversion mode, the audio content reproduced by the loudspeakers 102, 104 is inverted compared to the default mode.

For performing the detection task, the first microphone 116 located next to the first loudspeaker 102 and forming part of the earpiece 132 may be used for detecting a first detection signal. Furthermore, the second microphone 118 located at the position of the second loudspeaker 104 may detect a second detection signal. Based on the first detection signal and the second detection signal, the detection processing unit 112 then decides whether a left/right inversion is present or not provides, if necessary, a corresponding control signal to the control unit 114.

In the context of this detection and as shown in FIG. 1, the fourth loudspeaker 122 is simultaneously employed as a reference signal emission unit and emits a reference signal 150 for detection by both microphones 116, 118. Due to the fixed position of the signal emission unit 122 and due to its asymmetric arrangement with regard to the microphones 116, 118, there will be a time difference between a first point of time (or a first time interval) at which the reference signal 150 arrives at the position of the first microphone 116 and a second point of time (or a second time interval) at which the reference signal 150 arrives at the position of the second microphone 118. This time difference can be used for detecting whether there is a left/right inversion or not. In the example shown in FIG. 1 and as a consequence of the left/right inversion, the reference signal 150 arrives earlier at the position of the first microphone 116 as compared to an arrival time of the reference signal 150 at the position of second microphone 118. Therefore, the detection unit 112 may detect that there is a left/right conversion. Consequently, the audio data reproduced by the first and the second microphones 102, 104 may be inverted as well so as to compensate for the left/right inversion. In the absence of a left/right inversion, the reference signal 150 arrives earlier at the position of the second microphone 118 as compared to an arrival time of the reference signal 150 at the position of first microphone 116.

Due to the presence of the additional microphones 116, 118, the system of FIG. 1 can be operated as an Active Noise Reduction system as well.

In an embodiment, the detection of the presence or absence of a left/right inversion may be detected upon switching on the audio data reproduction system 100. It is also possible that the presence or absence of a left/right inversion is repeated dynamically, for instance in regular time intervals or upon predefined events such as the playback of a new audio piece.

In the following, referring to FIG. 2, an audio data reproduction system 200 according to another exemplary embodiment will be explained. The embodiments of FIG. 1 and FIG. 2 are very similar so that the corresponding features of FIG. 1 and FIG. 2 can also be implemented in the respectively other embodiment.

Figure 2:
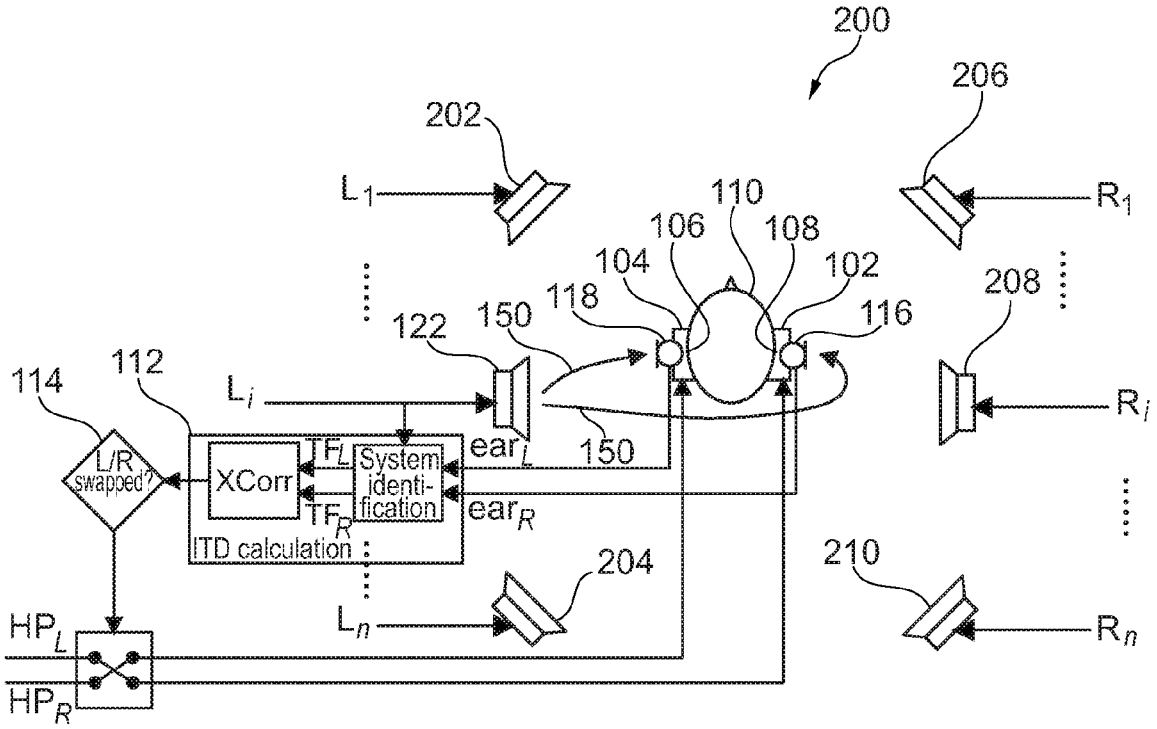
FIG. 2 illustrates another system of processing audio data according to an exemplary embodiment of the invention.

In the embodiment of FIG. 2, further loudspeakers 202, 204, 206, 208 and 210 are present. The listener 110, wearing stereo headphones 102, 104, has one or more of the loudspeaker(s) 202, 204, 206, 208 and 210 placed on his left and/or right sides. The headphones 102, 104 are equipped with a microphone 116, 118 on each side, which is for instance the case for Active Noise Reduction (ANR) headphones.

Let Li be the reference signal 150 played by loudspeaker 122 placed on the left side of the listener 110. It can be music played through the main car audio installation or a test signal (optionally inaudible) played automatically when the headphones 102, 104 are worn by the user 110. In FIG. 2, earL and earR are the signals recorded respectively by the left and right microphones 116, 118 on the headphones 102, 104.

Figure 3:
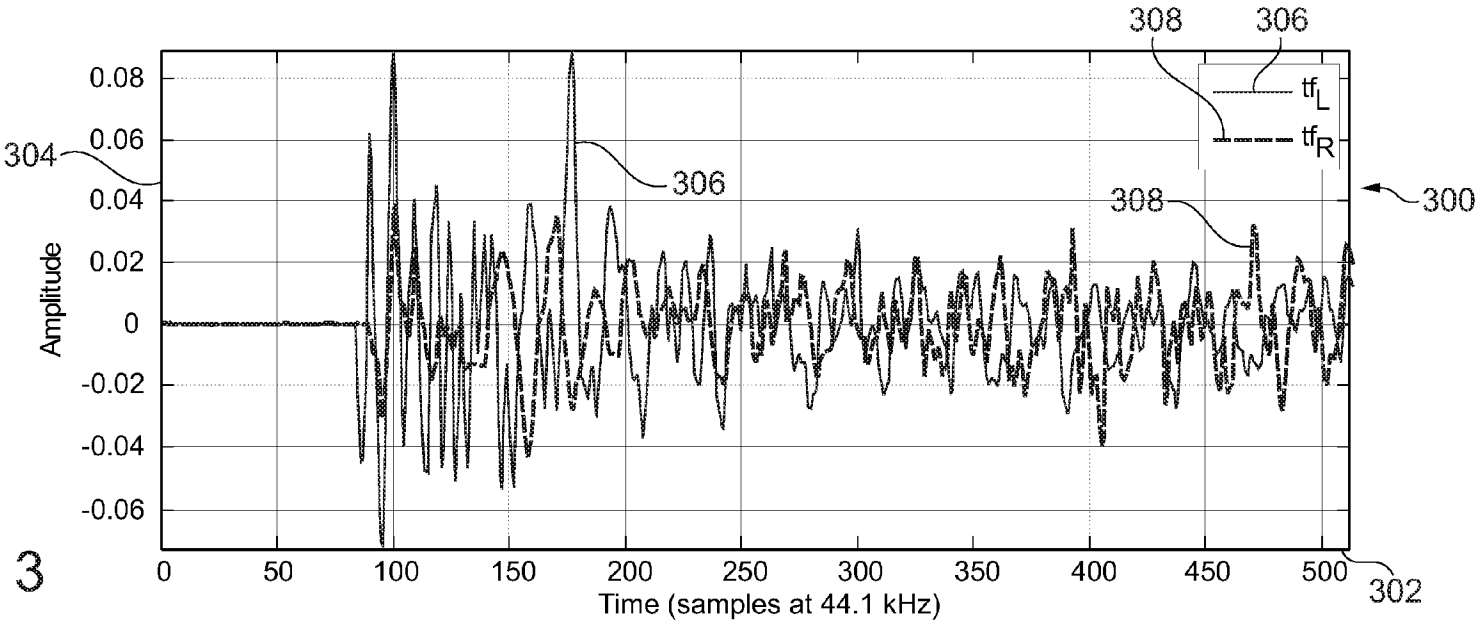
FIG. 3 shows left and right impulse responses from a reference loudspeaker to a left ear and to a right ear of a human listener.

FIG. 3 shows a diagram 300 having an abscissa 302 along which the time (samples at 44.1 kHz) are plotted. Along an ordinate 304, an amplitude is plotted. FIG. 3 shows a first curve 306 representing a left impulse response from the reference speaker 122 to the left ear 106. A second curve 308 shows a right impulse response from the reference loudspeaker 122 to the right ear 108.

Figure 4:
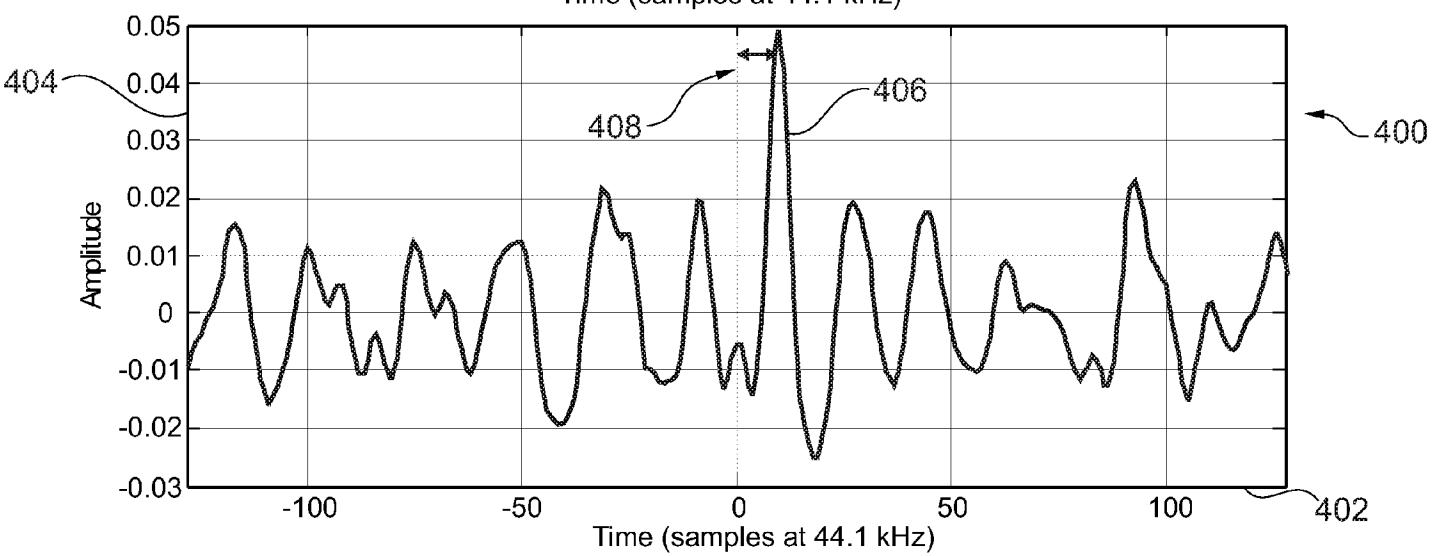
FIG. 4 shows a cross-correlation of the impulse responses according to FIG. 3, wherein an Interaural Time Difference is indicated by an arrow.

FIG. 4 shows a diagram 400 having an abscissa 402 along which the time (samples at 44.1 kHz) is plotted. Along an ordinate 404 the amplitude is plotted. FIG. 4 shows a curve 406 indicating a cross-correlation of the curves 306 and 308 shown in FIG. 3, wherein an Interaural Time Difference (ITD) is shown as an arrow 408. Thus, FIG. 4 shows a cross-correlation of tfL with tfR.

The time difference between earL and earR (called Interaural Time Difference, ITD) may be calculated in order to detect a possible left/right swap. This can (but does not have to) be done by means of a conventional system identification technique (such the well-know NLMS algorithm, Normalised Least Mean Squares filter) calculating the acoustical transfer functions between the reference loudspeaker 122 and the microphones 116, 118. The resulting left and right transfer functions (TFL and TFR respectively) are then cross-correlated and the time position of its maximum is the ITD between the earL and earR signals.

Another ITD calculation technique (not shown on the figure, but described in "Binaural positioning system for wearable augmented reality audio", Tikander, M.; Harma, A.; Karjalainen, M., Applications of Signal Processing to Audio and Acoustics, 2003 IEEE Workshop on., 19-22 Oct. 2003 pages 153-156, Digital Object Identifier) and which may be implemented in an exemplary embodiment of the invention consists in cross-correlating earL and earR by Li. The ITD then equals the time difference between the maxima of the right and left cross-correlations.

In another embodiment, it is also possible to derive the ITD by cross-correlating the earR and earL signals directly and determining its maximum. However, the methods described beforehand may reveal to be even more robust when multiple loudspeakers are enabled.

A positive (negative) ITD means that earR (earL) is time delayed compared to earL (earR). As in the present case the reference loudspeaker 122 is on the left side, a left/right swap only occurs when the calculated ITD is negative. For a reference loudspeaker 122 placed on the right side, the ITD must be positive to operate a left/right swap.

If multiple loudspeakers 122, 202, 204, 206, 208, 210 are playing simultaneously, the same process can be applied for some or each loudspeaker 122, 202, 204, 206, 208, 210. This may improve system reliability, especially in noisy environments.

It should be noted that the term "comprising" does not exclude other elements or features and the "a" or "an" does not exclude a plurality. Also elements described in association with different embodiments may be combined.

It should also be noted that reference signs in the claims shall not be construed as limiting the scope of the claims.

The invention claimed is:

1. A device for processing audio data, wherein the device comprises a first audio reproduction unit adapted for reproducing a first part of the audio data and adapted to be attached to a left ear of a user;

a second audio reproduction unit adapted for reproducing a second part of the audio data and adapted to be attached to a right ear of the user;

a detection unit adapted for detecting a left/right inversion of the first audio reproduction unit and the second audio reproduction unit, the detection unit comprising a first signal detection unit located at a position of the first audio reproduction unit and adapted for detecting a first audio detection signal and a second signal detection unit located at a position of the second audio reproduction unit and adapted for detecting a second audio detection signal; and a control unit adapted for controlling the first audio reproduction unit for reproducing the second part of the audio data and for controlling the second audio reproduction unit for reproducing the first part of the audio data upon detecting the left/right inversion, wherein the detection unit is adapted for detecting the left/right inversion based on the first audio detection signal and the second audio detection signal, and wherein the detection unit is adapted for detecting the left/right inversion by determining a time difference between the first audio detection signal detected by the first signal detection unit and the second audio detection signal detected by the second signal detection unit via calculating acoustical transfer functions between a signal emission unit and the first and second signal detection units or via correlating a reference signal emitted by the signal emission unit with the first and second audio detection signals.

2. The device according to claim 1, wherein the first signal detection unit comprises a first microphone and the second signal detection unit comprises a second microphone.

3. The device according to claim 1, further comprising the signal emission unit adapted for emitting the reference signal for detection by the first signal detection unit as the first audio detection signal and by the second signal detection unit as the second audio detection signal.

4. The device according to claim 3, wherein the signal emission unit is adapted for emitting at least one of an audible reference signal and an inaudible reference signal.

5. The device according to claim 3, wherein the signal emission unit comprises at least one further audio reproduction unit adapted for reproducing further audio data independently from the first audio reproduction unit and the second audio reproduction unit, the reproduced further audio data constituting the reference signal.

6. The device according to claim 3, wherein the signal emission unit is fixedly installed at a predefined reference position.

7. The device according to claim 1, wherein the first audio reproduction unit and the second audio reproduction unit are adapted for Active Noise Reduction.

8. The device according to claim 1, employed in one of a rear seat entertainment system for a vehicle, a congress system including headphones for translation, and an aircraft entertainment system.

9. The device according to claim 1, wherein the first audio reproduction unit and the second audio reproduction unit form part of one of a headset, a headphone and an earphone.

10. The device according to claim 1, employed in at least one of a mobile phone, a hearing aid, a television device, a video recorder, a monitor, a gaming device, a laptop, an audio player, a DVD player, a CD player, a harddisk-based media player, a radio device, an internet radio device, a public entertainment device, an MP3 player, a car entertainment device, a medical communication system, a body-worn device, a speech communication device, a home cinema system, a home theatre system, a flat television apparatus, an ambiance creation device, a studio recording system, and a music hall system.

11. A method of processing audio data, wherein the method comprises reproducing a first part of the audio data by a first audio reproduction unit to be attached to a left ear of a user;

reproducing a second part of the audio data by a second audio reproduction unit to be attached to a right ear of the user;

detecting a first audio detection signal at the first audio reproduction unit;

detecting a second audio detection signal at the second audio reproduction unit;

detecting a left/right inversion of the first audio reproduction unit and the second audio reproduction unit based on the first audio detection signal and the second audio detection signal;

upon detecting the left/right inversion, controlling the first audio reproduction unit for reproducing the second part of the audio data and controlling the second audio reproduction unit for reproducing the first part of the audio data, wherein the detecting the left/right inversion is effected by determining a time difference between the detecting of the first audio detection signal and the detecting of the second audio detection signal via calculating acoustical transfer functions between a signal emission unit and the first and second signal reproduction units or via correlating a reference signal emitted by the signal emission unit with the first and second audio detection signals.

12. A non-transitory computer-readable storage medium, comprising a computer program for processing audio data according to the method of claim 11.

* * * * *